US010065226B2

(12) United States Patent
Wang et al.

(10) Patent No.: US 10,065,226 B2
(45) Date of Patent: Sep. 4, 2018

(54) COOLING METHOD AND ON-LINE COOLING SYSTEM FOR CONTROLLED ROLLING WITH INTER-PASS COOLING PROCESS

(71) Applicant: NORTHEASTERN UNIVERSITY, Shenyang (CN)

(72) Inventors: Zhaodong Wang, Shenyang (CN); Bingxing Wang, Shenyang (CN); Junyu Wu, Shenyang (CN); Tian Zhang, Shenyang (CN); Yong Tian, Shenyang (CN); Yi Han, Shenyang (CN); Tianliang Fu, Shenyang (CN); Yong Li, Shenyang (CN); Guodong Wang, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 133 days.

(21) Appl. No.: 14/838,818

(22) Filed: Aug. 28, 2015

(65) Prior Publication Data

US 2017/0056944 A1 Mar. 2, 2017

(30) Foreign Application Priority Data

Aug. 24, 2015 (CN) ..... 2015 1 0524358

(51) Int. Cl.

*B21B 37/74* (2006.01)
*B21B 45/02* (2006.01)
*B21B 38/00* (2006.01)

(52) U.S. Cl.

CPC ..... *B21B 45/0218* (2013.01); *B21B 37/74* (2013.01); *B21B 38/006* (2013.01); *B21B 2261/20* (2013.01)

(58) Field of Classification Search

CPC ..... B21B 1/26; B21B 37/74; B21B 37/76; B21B 45/0203; B21B 45/0209;
(Continued)

(56) References Cited

U.S. PATENT DOCUMENTS 4,132,393 A * 1/1979 Nakamura ..... B21B 45/0218 266/113
4,274,273 A * 6/1981 Fapiano ..... B21B 37/74 700/153

(Continued)

FOREIGN PATENT DOCUMENTS

CN 202087603 U 12/2011
CN 202278020 U 6/2012

OTHER PUBLICATIONS

Chinese Office Action dated Apr. 7, 2016.
Chinese Office Action dated Nov. 17, 2016.
Chinese Office Action dated May 25, 2017.

*Primary Examiner* — Edward Tolan
(74) *Attorney, Agent, or Firm* — Symbus Law Group, LLC; Clifford D. Hyra

(57) ABSTRACT

The present invention relates to controlled cooling in manufacture of steel plate, and in particular, to an on-line cooling system for controlled rolling with an inter-pass cooling process, which comprises a rolling mill and on-line cooling equipment. The cooling equipment is accessorily arranged on the exit of the rolling mill, so that the rolling mill and the cooling equipment are combined. One rolling mill and one set of on-line cooling equipment are considered a cooling group, and several such groups are connected in series, so the steel plate can be cooled in any rolling pass. In this invention, both the cooling system and the water supply system are arranged on the main frame, and the rolling process and the cooling process are synchronized by using inter-pass cooling. Consequently, satisfied rolling effect in (Continued)

the condition of a temperature gradient along the thickness direction, grain refinement at the surface and drastic strength improvement without sacrificing toughness are achieved. Besides, better quality of the plate center region is obtained, double bulging is avoided and the yield of steel plate is improved due to the higher deformation permeability.

9 Claims, 4 Drawing Sheets

(58) Field of Classification Search
CPC ..... B21B 45/0218; B21B 1/32; B21B 1/34; B21B 45/0233; B21B 38/006; B21B 2261/20
See application file for complete search history.

(56) References Cited

U.S. PATENT DOCUMENTS 4,379,396 A * 4/1983 Hope ..... B21B 37/44 72/10.4
4,723,562 A * 2/1988 Wilmotte ..... B21B 45/0218 134/122 R
5,724,842 A * 3/1998 Beattie ..... B21B 37/74 72/12.2
6,264,767 B1 * 7/2001 Frank ..... B21B 1/34 148/547
6,309,482 B1 * 10/2001 Dorricott ..... B21B 37/74 148/602
7,052,647 B2 * 5/2006 Fujibayashi ..... B21B 45/0218 148/333
7,310,981 B2 * 12/2007 Kurz ..... B21B 37/74 148/511
7,981,358 B2 * 7/2011 Yamamoto ..... B21B 45/0218 266/113
2009/0194207 A1 * 8/2009 Oda ..... B21B 37/76 148/579
2014/0202224 A1 * 7/2014 Imanari ..... B21B 45/0218 72/201

* cited by examiner

COOLING METHOD AND ON-LINE COOLING SYSTEM FOR CONTROLLED ROLLING WITH INTER-PASS COOLING PROCESS

CROSS-REFERENCE TO RELATED APPLICATION

The present application claims priority to Chinese Patent Application No. 201510524358.9 filed Aug. 24, 2015, which is incorporated herein by reference in its entirety.

TECHNICAL FIELD

The present invention relates to controlled cooling in the manufacture of steel plate, and in particular, it relates to a cooling method and on-line cooling system for controlled rolling with an inter-pass cooling process.

BACKGROUND ART

With the development of the Chinese steel industry, the production volume, the quality and the variety of heavy or thick plate production have improved dramatically and more efforts are being put into further research with in-depth studies. TMCP (Thermo Mechanical Controlling Process) has been studied for many years and has proved to be an important method for improving the properties of steel plate products. When it comes to traditional heavy plate rolling, because of the low penetration of deformation, the defects of the core region are difficult to eliminate, there are many flaws and problems such as double bulging and edge overlap, the yield is low, the temperature cannot be properly controlled, the homogeneity of microstructure and structure is poor, especially in the thickness-direction, and productivity is low due to the long intermediate holding time for the intermediate slab.

The intermediate cooling process is a fast cooling process which controls the temperature of the intermediate slab between the rough rolling and the finish rolling. It has been applied to industrial production of heavy or thick plate for its ability to reduce holding time of the intermediate slab, increasing productivity, improving surface quality, and effectively suppressing austenite grain from coarsening.

Currently, laminar cooling equipment, which is arranged far away from the rolling mill, is generally used in the intermediate cooling process; it's very difficult to achieve a large temperature gradient in the thickness direction during rolling and precise control of plate temperature.

In general, ultra heavy plate is prone to the defect of lamellar tearing and poor property in the thickness direction (the Z direction). This is mainly because of segregation, holes, porosity, micro-cracks, poor homogeneity in the thickness direction or coarse grains existing in the center. Currently, there is no good solution for this problem.

CONTENTS OF THE INVENTION

To solve the problem above, this invention presents a cooling method and an on-line cooling system for controlled rolling with an inter-pass cooling process.

The embodiments of this invention present an on-line cooling system for controlled rolling with an inter-pass cooling process, which comprises rolling mill and on-line cooling equipment.

The said cooling equipment is accessorily arranged on the exit of the said rolling mill, so that the rolling mill and the cooling equipment are combined.

One rolling mill and one set of on-line cooling equipment are considered as a cooling group, and several such groups are connected in series, so the steel plate can be cooled in any rolling pass.

Further, the on-line cooling equipment comprises a main frame structure, cooling system, water supply system and transfer rollers.

The cooling system, water supply system and transfer roller are arranged on the main frame structure.

The water supply system is connected with the cooling system in order to provide water for the cooling system.

Transfer rollers are arranged in parallel.

Transfer rollers setting on the main frame are used to move the steel plate for rolling.

The cooling system is arranged above and/or under the transfer rollers to cool the plates on the transfer rollers.

Further, the water supply system comprises storage tank and water piping.

The storage tank is fixedly arranged on the main frame, and the two sides of the water piping are connected to the storage tank and the cooling system, respectively.

Further, the cooling system comprises a header, control valves and a detecting instrument.

One end of the header is arranged towards the transfer rollers and the other end connects with the water supply. The control valves and detecting instrument are arranged on the header.

Further, the header comprises an inlet pipe, internal spray tank, external spray tank, nozzles, and a support.

The inlet pipe, internal spray tank, and external spray tank are fixedly arranged on the main support. One end of the inlet pipe is connected with the water supply system. The nozzles are arranged on the other end of the inlet pipe.

Further, the cooling system comprises self-cooling setting for the nozzles and they are arranged on the side of transfer rollers for cooling the nozzles of the upper and lower cooling systems.

Further, the online cooling system also comprises a high pressure side jet water device and air blowing device. Both of them are arranged on the main frame, as well as on the side above the transfer rollers.

The invention also presents an on-line cooling method for controlled rolling with an inter-pass cooling process; the on-line cooling equipment is arranged on the exit of the rolling mill, so that the steel plate can be cooled immediately after each rolling pass.

Further, water is used as the cooling material in the cooling process.

When the on-line cooling system is used according to the parameters of the rolling plates, the plate temperature in length and width directions is detected by the pyrometers in real time and in each pass. During cooling, the start region, the end region and the edge region of the steel plate should be properly covered according to the temperature detected by the pyrometer to reduce the temperature gradient in length and width directions and to achieve good temperature homogeneity of the entire plate.

At the same time, the on-line plate temperature can be controlled by adjustment of the strength and the amount of the cooling water according to the temperature detected by the described pyrometers.

Further, the rolling mill includes a roughing mill and/or finishing mill, and one of them or both of them can be used in this invention.

The rough rolling and the finish rolling can be integrated together, when the finishing temperature of the rough rolling is low.

Alternatively, the cooling process of the intermediate slab can be repeated between the rough rolling and the finish rolling, when the finishing temperature of the rough rolling is high.

Alternatively, when the plate cannot be cooled to an expected temperature in a single pass cooling, a repeated cooling process can be used during a pass until the plate temperature meets the requirement.

This invention presents a cooling method and an on-line cooling system for controlled rolling with an inter-pass cooling process. The on-line cooling equipment is accessorily arranged on the exit of the rolling mill, so that the rolling mill and the cooling equipment are combined, and the steel plate can be cooled immediately after each pass rolling. The rolling process and the cooling process are subject to coupling control. Consequently, it can achieve good rolling effect under the condition of temperature gradient along thickness direction, grain refinement at the surface and drastic strength improvement without sacrificing toughness. When steel plate is rolled under the condition of temperature gradient in thickness direction, it is easier for deformation to penetrate into the center of the steel plate. For this reason, inner flaws of heavy or thick plates are eliminated, better quality in the plate center is obtained, plate shape defects such as lateral double bulging deformation are avoided and the yield of heavy or thick plate is increased.

DRAWINGS

In order to clearly explain the embodiments of the present invention and the technical solutions in the prior art, the following drawings will be briefly introduced. Apparently, the following drawings show some of the embodiments of this invention. For a person skilled in the art, other drawings based on the drawing provided in this invention can be also obtained without inventive work.

Figure 10A:
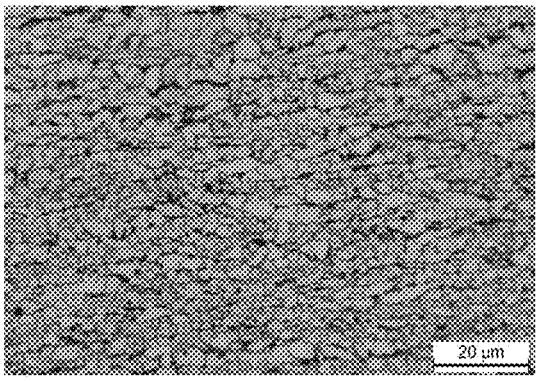
Figure 10B:
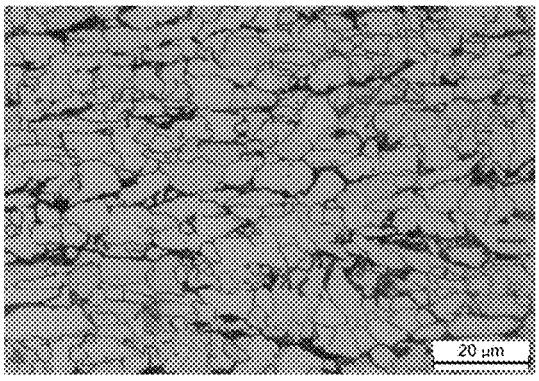

FIGS. 10A-B are metallographs of the surface and center of the plate after cooling with an on-line cooling system for controlled rolling with an inter-pass cooling process according to this invention.

REFERENCES IN THE DRAWINGS

1 water supply system, 2 main frame, 3 cooling system, 4 steel plate, 5 transfer roller, 6 upper detecting instrument, 7 upper header control valves, 8 upper header, 9 upper nozzle, 10 inlet pipe, 11 lower detecting instrument, 12 lower header, 13 lower header control valves, 14 lower nozzle, 15 self-cooling setting for the nozzle, 16 rough rolling mill, 17 on-line cooling equipment, 18 pyrometers, 19 air blowing device, 20 high pressure side jet water device, 21 finish rolling mill

EMBODIMENTS

The technical solutions of this invention will be described below with reference to the drawings. Apparently, the embodiments described below are only part of the present invention, and do not include all the possible embodiments. Based on the described embodiments in the present invention, all the other embodiments obtained by a person skilled in the art without inventive work should belong to the protection scope of this invention.

As shown in the drawing, an on-line cooling system for controlled rolling with inter-pass cooling is provided in the embodiments. The system comprises a rolling mill and the on-line cooling equipment 17.

The cooling equipment 17 is accessorily arranged on the exit of the rolling mill, so that the rolling mill and the cooling equipment 17 are combined. One rolling mill and one set of cooling equipment can be considered as a cooling group, and several such groups can be connected in series, so the steel plate for rolling can be cooled in any rolling pass.

In other words, cooling equipment is arranged behind each rolling mill, and the steel plate can be cooled after each rolling pass to achieve the best rolling result.

Rolling mill and cooling equipment 17 are considered as a cooling group and several such groups are connected in series. There are two connecting methods: rolling mills are connected together and at the same time, the corresponding cooling equipment is connected together. Alternatively, on-line cooling equipment 17 is arranged at the exit of each rolling mill and at the same time, the entrance of the rolling mill is arranged at the exit of each on-line cooling equipment 17, namely, the rolling mill and the cooling equipment 17 are arranged at intervals.

Figure 7:
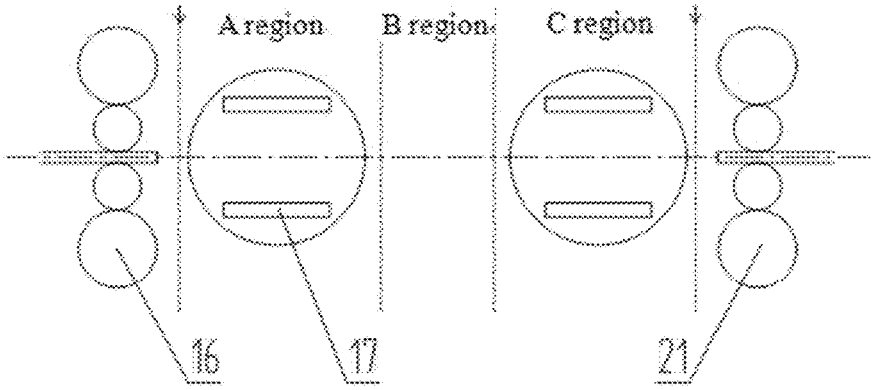
FIG. 7 is a schematic drawing of the double stand rolling mill used in a cooling method for controlled rolling with an inter-pass cooling process according to this invention.
Figure 8:
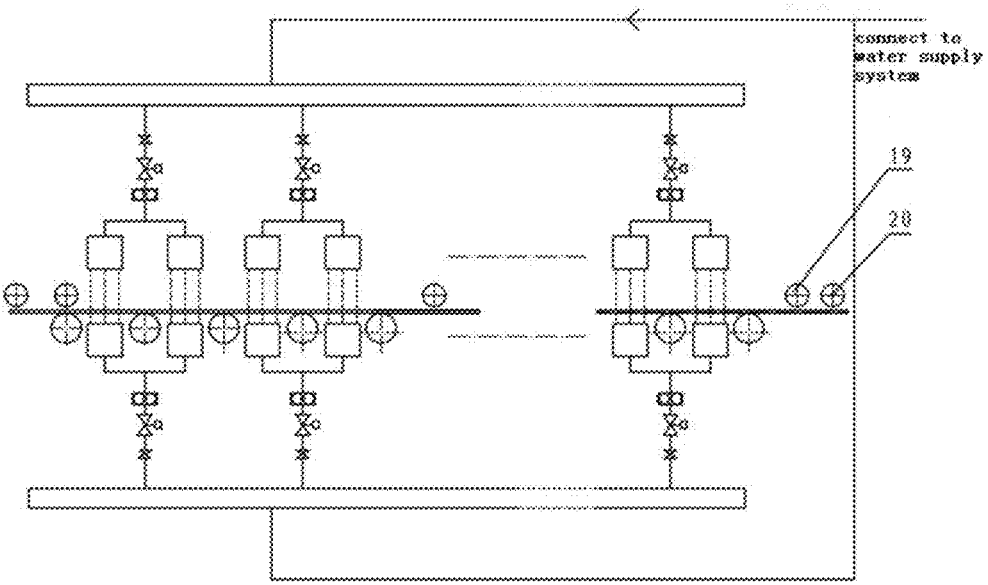
FIG. 8 is a schematic drawing of the first cooling system arranged on the exit of the roughing mill in the on-line cooling system for controlled rolling with an inter-pass cooling process according to this invention.
Figure 9:
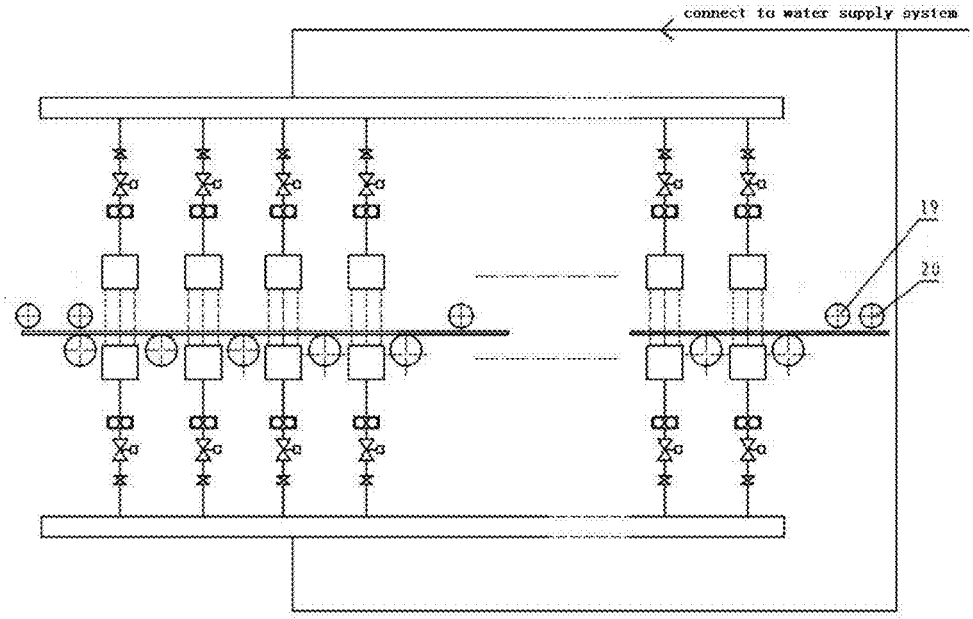
FIG. 9 is a schematic drawing of the second cooling system arranged at the entrance of the finishing mill in the on-line cooling system for controlled rolling with an inter-pass cooling process according to this invention.

Take the double-stand mill production line as the example, FIG. 7 shows the process arrangement for an on-line cooling system for controlled rolling with an inter-pass cooling process.

Figure 1:
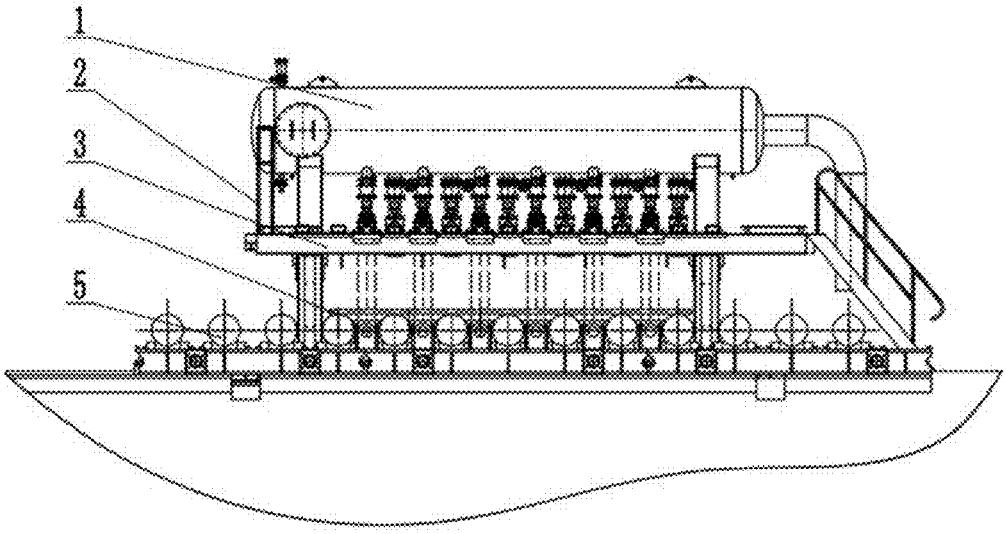
FIG. 1 is a schematic drawing of the structure of the on-line cooling system for controlled rolling with an inter-pass cooling process according to this invention.

The first on-line cooling equipment 17 is arranged behind the exit manipulator of the rough mill 16, and it is used mainly for enhancing the cooling process for the intermediate slab and synchronizing the rolling and the cooling during the rough rolling stage, as shown in FIG. 1. The effective cooling zone is 6400 mm long, and the maximum width is 3500 mm. In the whole cooling zone, 8 sets of headers are located on both up and down sides, all the headers use high density and fast injection nozzles, all injecting water with a designed angle and with high pressure. The distance between upper nozzles 9 and the roller surface is 1000 mm, lower header 12 is located between two rollers, and these 420 mm diameter rollers are arranged with an 800 mm interval, the distance between lower nozzles 14 and the roller surface is 300 mm. Since the rough rolling does not need too much precise adjustment, one set of valves can control two headers.

The second on-line cooling equipment 17 is located before the manipulator of the finish mill 21, and it is used to synchronize the rolling and the cooling for the finish rolling stage, as shown in FIG. 1. The effective cooling zone is 4800 mm long, and the maximum width is 3500 mm. In the whole cooling zone, 8 sets of headers are located on both up and down sides, all the headers use high density and fast injection nozzles, all injecting water with a designed angle and with high pressure. The distance between upper nozzles 9 and the roller surface is 1000 mm, lower header 12 is located between two rollers, and these 420 mm diameter rollers are arranged with an 800 mm interval, the distance between lower nozzles 14 and the roller surface is 300 mm. Since much more precise adjustment is needed for the finish rolling, every header has its own valve. This design can achieve homogeneity of cooling, and have the flexibility to meet different process requirements.

For the single stand mill, the arrangement of the cooling equipment 17 is similar to that of the cooling equipment 17 arranged close to the finish mill 21.

Preferably, the on-line cooling equipment 17 comprises the main frame 2, cooling system 3, water supply system 1 and transfer rollers 5.

Cooling system 3, water supply system 1 and transfer roller 5 are all arranged on the main frame 2.

Water supply system 1 is connected with cooling system 3 in order to provide water for cooling system 3.

Transfer rollers 5 are placed in parallel.

Transfer rollers 5 arranged on the main frame 2 are used to move the steel plate 4 for rolling.

The cooling system 3 is arranged above and/or under the transfer rollers 5 to cool the plates 4 on the transfer rollers 5.

Figure 2:
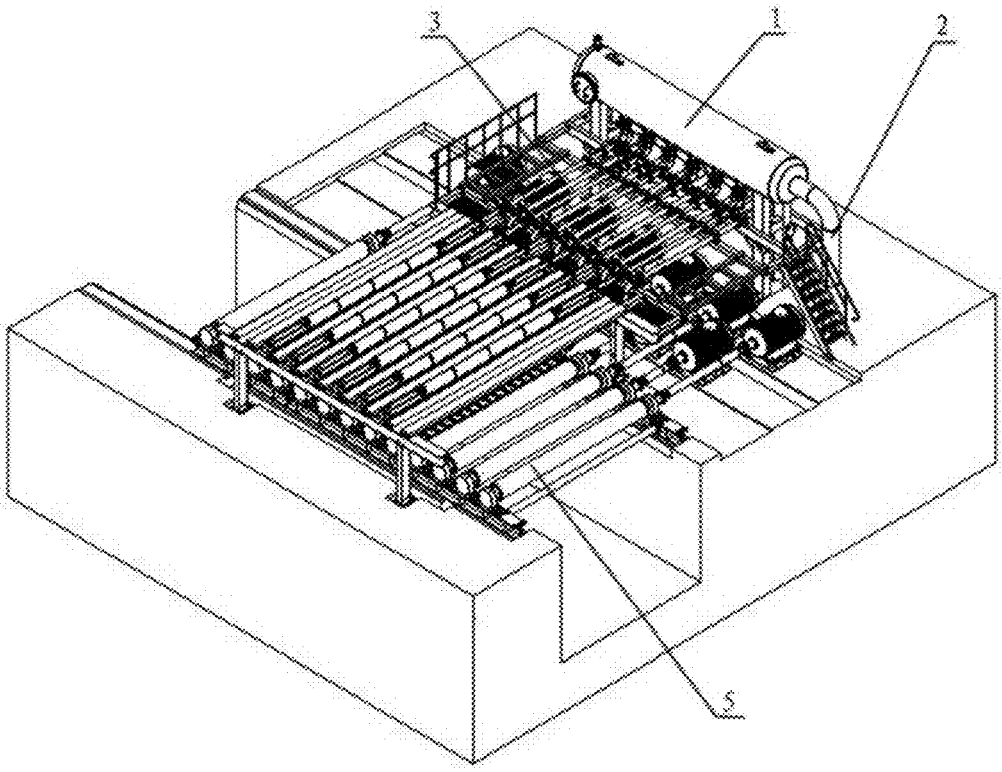
FIG. 2 is an isometric drawing of the on-line cooling system for controlled rolling with an inter-pass cooling process according to this invention.

The structure of the on-line cooling equipment 17 in this invention is shown in FIG. 1 and FIG. 2, and it is comprised of water supply system 1, main frame 2, cooling system 3, steel plate 4 and transfer rollers 5.

After the rolled steel plate exits from the rolling mill, it goes onto the transfer rollers 5 of the on-line equipment. The steel plate on the transfer rollers 5 can be cooled in two directions (up and down) at the same time, since the cooling system 3 is arranged both above and under the transfer rollers 5, which can increase the cooling rate and efficiency.

Preferably, the water supply system 1 comprises a storage tank and water piping. The storage tank is fixedly arranged on the main frame 2, and the two ends of the water piping are connected to the storage tank and the cooling system 3, respectively. The storage tank is to ensure sufficient water supply for the water supply system 1, and then to guarantee the cooling performance for the cooling system 3.

Preferably, the cooling system 3 comprises a header, header control valves and a detecting instrument.

One end of the header is arranged towards the transfer rollers 5 and the other end is connected with the water supply system 1. The header control valves and the detecting instrument are arranged on the header.

The cooling system 3 is arranged both above and under the transfer rollers 5, the above portion is regarded as the upper cooling system and the below portion is regarded as the lower cooling system. Upper cooling system comprises upper header 8, upper header control valves 7 and detecting instrument 6. The lower cooling system comprises lower header 12, lower header control valves 13, detecting instrument 11 and runoff pipes. The runoff pipes are used for discharging waste water.

The upper header 8 is arranged above the transfer rollers 5, water is supplied to the upper header 8 by water supply system 1, the spray speed of the upper header 8 is controlled by the upper header control valves 7 and its working state is detected by the detecting instrument 6, in order to achieve the best working state. The lower header 12 is arranged under the transfer rollers 5, water is supplied to the lower header 12 by water supply system 1, the spray speed of the lower header 12 is controlled by the lower header control valves 13 and its working state is detected by the detecting instrument 11, in order to achieve the best working state.

Preferably, the header comprises inlet pipe 10, internal spray tank, external spray tank, nozzles, and support.

The inlet pipe 10, internal spray tank, and external spray tank are arranged on the support.

The two ends of the inlet pipe are connected with water supply system 1 and nozzles, respectively.

The upper header 8 and the lower header 12 can both be high density and fast injection, they comprise inlet pipe 10, internal spray tank, external spray tank, nozzles, and support, and the header width ranges from 2500 mm to 5500 mm.

Preferably, the cooling system also comprises a self-cooling setting for the nozzle. Self-cooling settings for the nozzles are arranged on the side of transfer rollers for cooling the upper nozzle 9 of the upper cooling system and the lower nozzle 14 of the lower cooling system.

In order to protect the equipment, especially the upper nozzles 14, from the heat of the steel plate 4, when the cooling system is not used, the self-cooling mechanism is hence applied to the nozzles.

Preferably, the on-line instant cooling system for controlling the property of the steel plate 4 by inter-pass cooling also comprises high pressure side jet water device 20 and air blowing device 19, and both of them are arranged on the main frame 2 and both above the transfer rollers 5 on the sides In addition, they are arranged at both entrance and exit, in order to blow the left water on the steel surface, a set of DN65 valve and fast response valve are used for each of them.

The invention also presents a cooling method for controlled rolling with an inter-pass cooling process. The cooling equipment 17 is arranged on the exit of the rolling mill, so that the steel plate 4 can be cooled immediately after each rolling pass by the on-line cooling equipment 17. The rolling and the cooling are subject to coupling control. Consequently, it can achieve a good rolling effect under the condition of a temperature gradient along the thickness direction, grain refinement at the surface and drastic strength improvement without sacrificing toughness. When steel plate is rolling under the condition of a temperature gradient in the thickness direction, deformation more easily penetrates into the center of the steel plate. For this reason, inner flaws of heavy or thick plates are eliminated, better quality in the plate center is obtained, plate shape defects such as double bulging deformation are avoided and the yield of heavy or thick plate is increased.

In this invention, the microstructure and the property of steel plates 4 are controlled by the inter-pass cooling process, using the on-line cooling equipment according to this invention. Finally, the productivity, the efficiency, the cooling uniformity, the yield, the strength, the toughness and the Z-performance (i.e. the performance in the Z direction) will be improved significantly, by the effective combination of the high intensity inter-pass cooling with the rolling, and by controlling the rolling parameters and the cooling parameters precisely.

The grain refinement in the surface layer of the plate in this invention is achieved by strain induced ferrite transformation, microalloyed carbonitrides precipitation and the recrystallization of low temperature microstructure.

Surface temperature of the plate 4 can reach to Ac3-Ad3 after inter-pass cooling, and during deformation at this temperature, austenite at the surface will transform to ferrite induced by strain.

The meaning of strain induced ferrite transformation is: as the deformation of austenite in non-recrystallization temperature reaches a critical value, equiaxial and continuous ferrite grains with low dislocation density will form on the austenite grain boundary in the surface layer. With the deformation increasing, the nucleation sites change from grain boundary to the deformation band inside the grain and the nucleation rate increases dramatically. The strain induced ferrite transformation is dominated by nucleation and the transformation is very fast. Nucleation sites will increase with the increasing deformation bands, and precipitations are also the preferred nucleation sites. In addition, the critical nucleation size is smaller than other transformation.

In the process of inter-pass cooling, a surface layer of the steel plate 4 stays for a long time in a lower non-recrystallization temperature region, which comprises the nose temperature of microalloyed (esp. Nb) carbonitrides precipitation, so that microalloyed carbonitrides will precipitate greatly in the surface layer in the process of holding and deforming, which refines the induced ferrite grains by supplying more nucleation sites. On the other hand, repeated phase transformation in the surface layer of steel plate 4 during the inter-pass cooling process also contributes to the grain refinement.

Figure 3:
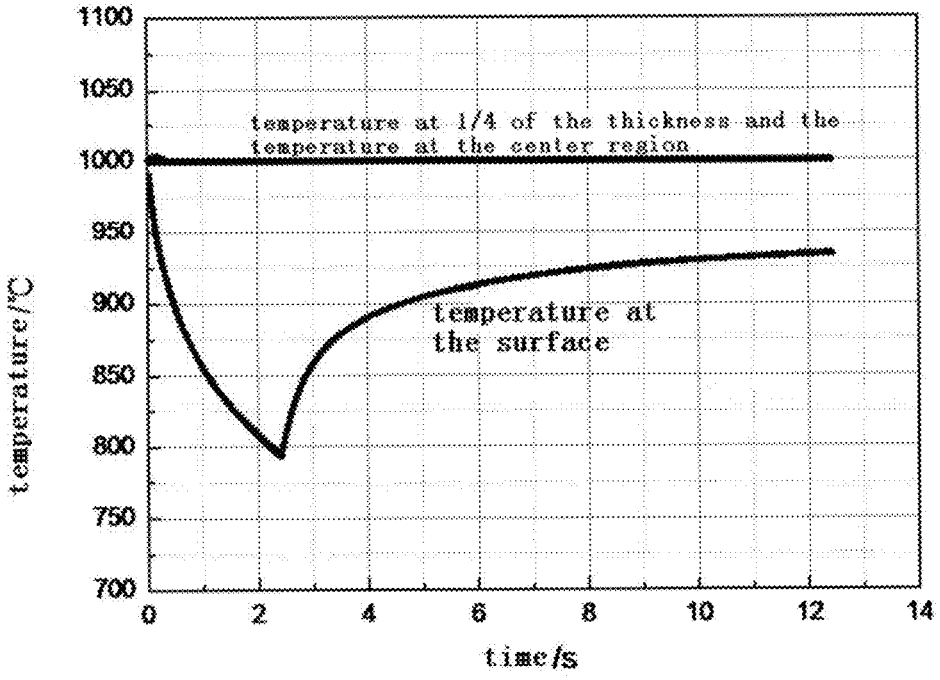
FIG. 3 is a schematic drawing showing the temperature change in different thickness layer of the plate during inter-pass cooling according to a cooling method for controlled rolling of this invention.
Figure 4:
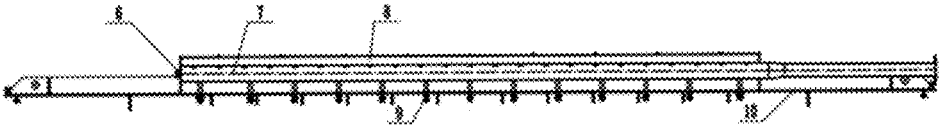
FIG. 4 is a schematic drawing of the structure of the upper cooling system of the on-line cooling system for controlled rolling with an inter-pass cooling process according to this invention.
Figure 5:
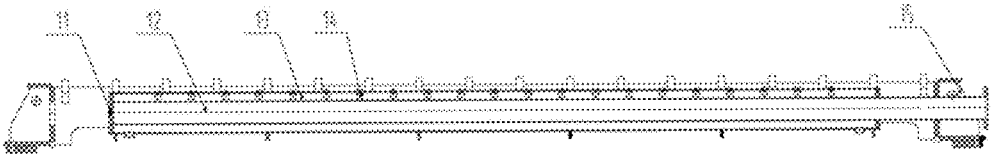
FIG. 5 is a schematic drawing of the structure of the lower cooling system of the on-line cooling system for controlled rolling with an inter-pass cooling process according to this invention.
Figure 6:
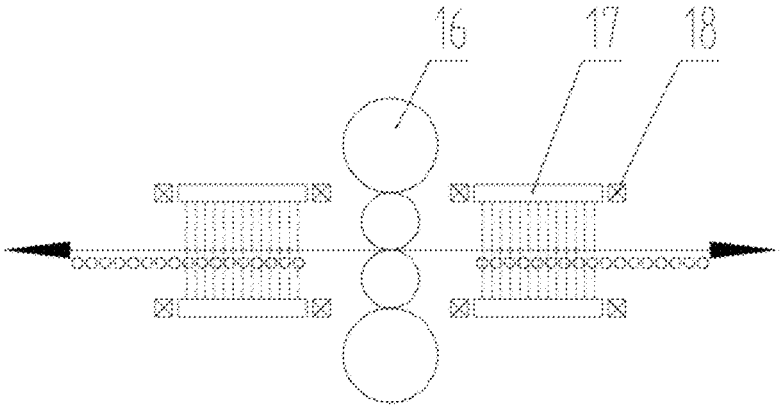
FIG. 6 is a schematic drawing of the single stand rolling mill used in a cooling method for controlled rolling with an inter-pass cooling process according to this invention.

Inter-pass cooling includes cooling before rolling, cooling after rolling and a combination of both. FIG. 3 shows the temperature variation curve in different thickness layers of a 150 mm thick plate 4 during and after inter-pass cooling. Cooling before rolling is mainly used to lower the surface temperature for rolling, and may cause a temperature gradient in the thickness direction of the plate, while cooling after rolling could suppress grain growing in a surface layer of the plate 4. With the combination of the two processes, the temperature gradient in the thickness direction of the plate 4 will be further increased, deformation penetration of rolling will be improved, and at the same time, microstructure through the thickness direction including at both the surface and the core will be refined, and intermediate holding time of the intermediate slab will be reduced. With the help of a temperature sensing system, by controlling the roller speed, rolling speed, cooling strength and cooling rate, the temperature of the steel plate 4 can be controlled precisely, and the best temperature gradient can be achieved for deformation in the rolling process, as a result, microstructure distribution in the thickness direction of the plate can be under control to a certain extent, and the flexibility and the precision of temperature are improved during controlled cooling.

When the temperature of the whole steel plate 4 is in the recrystallization region, large reduction or large compression in every pass is needed to get fine austenite grains. If a single-pass or multi-pass inter-pass cooling process is conducted before the rolling, the temperature near the surface layer may be decreased to be within the non-recrystallization region, resulting in a large temperature gradient in the thickness direction. On the one hand, lots of deformation bands and dislocations that can offer more nucleation sites in the following recrystallization are induced by non-recrystallization deformation of surface austenite. On the other hand, the same effect as traditional rolling can be achieved even under reduced pass reduction, so that larger reduction can be applied during subsequent rolling in non-recrystallization region.

When the temperature of the steel plate 4 is within the non-recrystallization region, the temperature near the surface layer may be decreased below the phase transition point or even lower with strong inter-pass cooling, the temperature at the sub surface is a little higher, and the temperature at the center is changed slightly, resulting in a large area of ferrite near the surface layer and much pre-eutectoid ferrite in the sub surface layer, while no phase transition occurs in the center of the plate. As the cooling time is not enough to cause complete transformation, there would remain some undercooling austenite in the surface and the sub surface layer of the steel plate 4 after the cooling. When the plate is deformed in the following rapid reheating process after inter-pass cooling, because of the raised Ac3 temperature, the ferrite in the surface and the sub surface layer would be stable at high temperature, and as a result, the ferrite grains will deform and recrystallize at high temperature. When it reaches to a critical deformation, austenite in the surface and the sub surface layer within the temperature region of Ac3-Ad3 will induce ferrite transformation, and the resulting formed ferrite grains are limited to grow up due to the collision. In the following heating process, the deformed austenite grain will recrystallize and fine grains are obtained. Furthermore, precipitating microalloyed carbonitrides during heating may pin the induced ferrite grain boundary and offer nucleation sites in the recrystallizing and transforming process, hence the grains are further refined significantly.

In the following heating process, if the temperature is high, recrystallized pre-eutectoid ferrite and strain induced ferrite will transform to finer austenite. When the temperature is low, the next inter-pass cooling process can be started immediately, the super fine ferrite grains at the surface will be kept to the next pass of the controlled rolling, resulting in the accumulation effect of the fine ferrite grains. Furthermore, for heavy or thick plate, the pass reduction of the austenite in the recrystallization region is relatively low, the refining effect of austenite grains under controlled rolling with an inter-pass cooling process is better than that under austenite recovery and static recrystallization only. The strength of the ferrite grains induced by deformation is higher than that of the traditional coarse ferrite because of carbon atom saturation. Besides, the strength of the matrix and the plate is also improved by dislocation and substructure. In summary, an inter-pass cooling process can be used to improve the properties of the steel plate 4.

Preferably, water is used in the cooling process in this invention.

When the on-line cooling equipment 17 is used according to the parameters of the rolling plates 4, the plate temperature in length and width directions is detected by the pyrometers 18. During the cooling process, the start region, the end region and the edge regions of the steel plate 4 should be properly covered according to the temperature detected by the pyrometers 18 to reduce the temperature gradient in length and width directions and to achieve good temperature homogeneity on entire plate 4.

At the same time, on-line plate temperature can be controlled by the adjustment of the amount and the cooling strength of water according to the temperature detected by the described pyrometers 18.

During the rolling, temperature uniformity controlling for the start region, the end region and the edges regions of the steel plate can help to achieve uniform temperature, microstructure and properties on entire plate 4 at each direction.

As to plates with large width, the temperature in the edge region in the width direction is most likely to be lower. To keep the temperature uniform in the width direction of the steel plate 4, the cooling strength of the plate edge region is designed to be lower than that of the plate center during the inter-pass cooling process, in order to compensate the over-cooling in the edge region, and as a result of this design of water crown, homogeneous property and good plate shape are achieved for the rolled plate 4, and problems such as plate wave edge are overcome.

Water is used in the cooling process in this invention, but it is necessary to explain that other cooling methods, such as air cooling and so on, which can cause rapid temperature drop of the plate, are also applicable.

Preferably, the rolling mill includes roughing mill 16 and/or finishing mill 21. There are two arrangement forms of the rolling mill, one is a single stand rolling mill (with only roughing mill 16 or finishing mill 21) and the other one is a double stand rolling mill (with both roughing mill 16 and finishing mill 21). Correspondingly, there are two arrangement forms of the on-line cooling equipment. When it comes to the single stand rolling mill, two inter-pass cooling systems each with a length of 4-8 m are arranged on both sides of the rolling mill closely beside the manipulator respectively (specific location depends on production condition, e.g., on the entrance, on the inner side or the outer side of the manipulator at the exit). When it comes to the double stand rolling mill, generally there are also two inter-pass cooling systems, one inter-pass cooling system with a length of 4-8 m is arranged at the exit of the roughing mill 16, while the other inter-pass cooling system with the same length is arranged at the entrance of the finishing mill 21 on the inner side or the outer side of the manipulator, depending on production conditions.

There are two arrangement forms of rolling mills, single stand rolling mills (only rough mill or finish mill) and double stand rolling mills (rough mill and finish mill).

The cooling method can be explained by the following 4 embodiments.

Embodiment 1

Rough rolling and finish rolling can be integrated when the finishing temperature of rough rolling is low.

150 mm thick continuous casting is used in this embodiment of the present invention, and the chemical composition of the continuous casting is shown in table 1. The continuous casting is heated to 1200° C. and held for 120 minutes in order to acquire complete austenite in the plate, then the first stage rolling would be started when the temperature of the continuous casting dropped to 1100° C.

In the first stage, the continuous casting is cooled by the nearest inter-pass cooling group, then goes through the roller without deformation, and continues to be cooled when it exits from the roller by the cooling system arranged on the other side of the rolling mill. Afterwards, the casting is cooled for the third time when entering the roller, maximum water flow is used for all three cooling process, and the cooling rate of the surface layer is larger than 15° C./s all the way to ensure the cooling depth along the thickness direction. Surface temperature of the casting 4 is decreased to 880° C. and the reduction is 18-20 mm during rolling. After the rolling, the plate is cooled immediately with strong cooling water in order to suppress rapid heating in thw surface layer after the deformation, so that the deformed grains at the surface would be inhibited from growing and the temperature gradient in the thickness direction of the plate 4 would be maintained to some extent. Subsequently, the plate 4 is cooled for three times with the inter-pass cooling process and then deformed repeatedly by the roller with the same reduction as is introduced above until the plate thickness is decreased to 95 mm. The cooling strength in the first stage reached the maximum value of the inter-pass cooling equipment. The second stage would commence after the plate thickness is decreased to 95 mm.

In the second stage, the temperature in the center area reaches the non-recrystallization region of austenite, the plate is relatively thin, the pass reduction is reduced to 13-15 mm and the inter-pass cooling scheme is adjusted: the plate surface is cooled to 500-600° C. firstly, then re-reddened to 750-850° C. by the adjustment of cooling strength, amount of cooling water, cooling rate, roller speed and in the combination with the temperature detection system before every pass. The plate 4 is finally rolled to 40 mm and the finishing rolling temperature is 750° C. Soon afterwards, the plate 4 is cooled to 500-550° C. with a cooling rate higher than 10° C./s and reheated to 600-650° C. by means of re-reddening, after that the plate 4 is held in the air to be cooled to 300° C. and then stack cooled.

The metallograph at the surface and the center of the final plate 4 are shown in FIG. 10 (*a*) and FIG. 10 (*b*). It can be seen from the figures that the grains at the surface are finer with size ranging from 2 to 7 μm, and the grain size at the center is in the range of 8-20 μm. The grain size is relatively homogeneous with relatively small differences between the surface and the center. In this embodiment, the rough rolling and the finish rolling are integrated, and as a result, productivity is greatly improved, the microstructure in thickness direction is relatively even and the surface grains are fine.

Embodiment 2

When the finishing temperature of rough rolling is high, the cooling process of the intermediate slab can be repeated between rough rolling and finish rolling.

150 mm thick continuous casting is used in this embodiment. The continuous casting is heated to 1200° C. and held for 120 minutes, after that the plate is rolled successively in the recrystallization region with the pass reduction of 20-25 mm. High strength inter-pass cooling is used for the steel plate as the plate enters and exits from the rollers, the cooling rate is higher than 15° C./s. The finishing temperature of rough rolling is 1030° C. and the thickness of the intermediate slab is 90 mm. Afterwards, successive reciprocating cooling is carried out using the inter-pass cooling equipment beside the rolling mill until the temperature of the plate 4 is dropped to 950° C.

During finish rolling, the pass reduction is reduced to 13-15 mm. The plate surface is cooled to 500-600° C. firstly, then re-reddened to 750-850° C. by the adjustment of amount of water, cooling strength, cooling rate, roller speed and in combination with the temperature detection system before every rolling pass. The plate 4 is finally rolled to 40 mm thick and the temperature of the finishing rolling is 760° C.

Afterwards, the plate 4 is cooled to 500-550° C. with a cooling rate higher than 15° C./s and then reheated to 600-650° C. by means of re-reddening, after that the plate is held in the air to be cooled to 300° C. and then stack cooled.

In this embodiment of the present invention, successive reciprocating cooling is applied between rough rolling and finish rolling. Because the temperature of the sub surface stays at the nose temperature of microalloyed carbonitrides precipitation for a long time in the cooling process, microalloyed carbonitrides precipitation in the austenite are accelerated and the precipitates could provide more nucleation sites for the following transformation (including induced transformation), which can greatly refine the microstructure and reduce the grain size.

Embodiment 3

When the plate cannot be cooled to the expected temperature in single pass cooling, a reciprocating inter-pass cooling process can be used during pass until the temperature of the plate meets the requirement.

In this embodiment of the present invention, the plate 4 is rolled successively in the high temperature region and then cooled by UFC (ultra fast cooling) equipment.

150 mm thick continuous casting is used in this embodiment of the present invention. The continuous casting is heated to 1200° C. and held for 120 minutes, subsequently the temperature of the continuous casting is dropped to 1150° C. In the first stage, the plate is rolled successively with the pass reduction of 20-25 mm, while thrice an inter-pass cooling process is carried out before every rolling pass. The surface temperature is kept at 900-950° C. by the adjustment of water amount, cooling strength, cooling rate, roller speed and in combination with the temperature detection system before every pass. The plate 4 is finally rolled to 40 mm thick and the finishing rolling temperature is 950° C. Then the plate is cooled to 500-550° C. with a cooling rate of above 15° C./s by UFC equipment and reheated to below 650° C. by means of re-reddening, the cooling rate is relatively higher by means of ultra fast cooling so that the hardened deformed austenite could be kept at low temperature without recrystallization softening. After that the plate is held in the air to be cooled to 300° C. and then stack cooled. In this embodiment, TMCP technology which combines rolling and inter-pass cooling is adopted, with ultra fast cooling as the key factor. Because of the high temperature for deformation, the load of the rolling mill is low and the rhythm of the rolling is sped up, as a result, energy consumption of the rolling process is decreased and productivity is improved. Inter-pass cooling could suppress the softening of deformed austenite and the growing of recrystallized austenite grains, while the small amount of Nb added in this embodiment would make it efficient by increasing the recrystallization temperature. As the steel plate 4 is rolled under the condition of a temperature gradient along the thickness direction, the sub surface of the plate is always kept in the non-recrystallization region. With the help of the ultra fast cooling after rolling, the grains at the surface are greatly refined. Furthermore, benefiting from the improved deformation permeability, microstructure in the thickness direction of the plate is even and Z-direction property of the plate is increased.

Embodiment 4

The plate 4 is rolled once at high temperature, and then cooled to non-recrystallization region by ultra fast cooling equipment, and rolled in the non-recrystallization region successively.

150 mm thick continuous casting is used in this embodiment of the present invention. The continuous casting is heated to 1200° C. and held for over 120 minutes, after that the temperature of the continuous casting is dropped to 1100° C. After a thrice strong cooling process, the plate is rolled once with a reduction of 25-30 mm. Subsequently, the plate is continuously cooled by ultra fast cooling equipment until the temperature of the center is below 950° C., and then the plate is sent back to the rolling mill.

The maximum water flow is used for inter-pass cooling, and the surface layer of the plate is cooled to below 550° C. by inter-pass cooling equipment so that the austenite in the surface layer could be transformed to ferrite as much as possible, and then the temperature rises again to 700-750° C. through a temperature homogenization process called re-reddening process. The pass reduction is less than 10 mm due to the low deformation temperature. The plate is finally rolled to 40 mm, while the finishing rolling temperature is 780° C.

Afterwards, the plate 4 is cooled to 500-550° C. by UFC equipment and the temperature rises again to about 600° C. by re-reddening process, then the plate is held in the air to be cooled to 300° C. and then stack cooled.

In the this embodiment, the plate is mostly deformed in the non-recrystallization region. On the one hand, austenite recovery and recrystallization is inhibited, on the other hand, the surface layer temperature of the plate is maintained low enough in the inter-pass cooling process so that the surface microstructure could be transformed between austenite and ferrite repeatedly during repeated process from cooling to re-reddening, which results in fine grains in the surface layer. Besides, because of the rapid rolling and cooling rhythm, there is not enough time for the low temperature ferrite microstructure in the sub surface layer to transform back to austenite so that the ferrite percentage in the surface layer would be much larger than other embodiments because of the accumulation in the multi-pass cooling process, and, the recovery and the recrystallization of the surface ferrite could contribution greatly to further grain refinement in the surface layer of the plate.

Compositions used in this invention are not limited to the four options as listed in Table 1. FIGS. 10A-B show the typical metallographic structure using the typical composition and TMCP process, and the grain refining effect using other compositions and processes is similar to that shown in FIGS. 10A-B, so they are not listed in this invention.

TABLE 1

Compositions (wt. %) used in the embodiments of this invention:

| Embodiment | C | Mn | Si | P | S | V | Ti | Nb | Als |
|---|---|---|---|---|---|---|---|---|---|
| Embodiment 1 | 0.15 | 0.62 | 0.25 | 0.011 | 0.003 | 0.008 | 0.12 | — | 0.021 |
| Embodiment 2 | 0.13 | 0.71 | 0.23 | 0.012 | 0.004 | 0.007 | 0.10 | — | 0.018 |
| Embodiment 3 | 0.12 | 0.79 | 0.24 | 0.013 | 0.003 | 0.009 | 0.07 | 0.03 | 0.015 |
| Embodiment 4 | 0.09 | 0.85 | 0.22 | 0.012 | 0.005 | 0.007 | 0.06 | 0.01 | 0.023 |

In this invention, the rolling process and the cooling process are combined and effectively synchronized by using inter-pass cooling equipment installed beside the rolling mill so that the steel plate can be quickly cooled in any rolling pass. Since the inter-pass cooling equipment is installed on the existing frames, no additional space and additional cooling time is required, and the cooling efficiency and space utilization is improved significantly. With this invention, the cooling process is arranged to every single rolling process, the cooling is synchronized with the rolling process, and then it is possible to have refined cooling control during the rolling process.

Space utilization of the production line is improved. The inter-pass cooling equipment is accessorily arranged beside the rolling mill, and the ultra fast cooling system can take the place of an existing intermediate spray cooling system, therefore, no specific space is needed and space utilization of the production line is improved.

Productivity is improved. Ultra fast cooling in the rolling process can shorten the holding time of the intermediate slab, and could increase the rolling efficiency by more than 20 percent.

Plate properties are improved. The rolling mill and the cooling equipment are combined, satisfied rolling effect in the condition of temperature gradient along the thickness direction, grain refinement at the surface and drastic strength improvement without sacrificing toughness are achieved. When a steel plate is rolling in the condition of a temperature gradient in the thickness direction, deformation more easily penetrates into the center of the steel plate. For this reason, inner flaws of heavy plates are eliminated, better quality of the plate center is obtained, double bulging deformation is avoided and the yield of heavy plate is increased.

Contribution is made to the promotion of the research and development of high strength and high quality steel plate. The production becomes less difficult and the mechanical properties are improved. It becomes easier to produce high performance steel plate by the inter-pass fast cooling and the optimal control of the reduction. World-class high performance steel plate can be developed, such as carbon manganese steel, HSLA steel, high Z-direction property heavy plate and ultra heavy plate used in ocean engineering and construction engineering, and steel plate with high crack arrest property.

The temperature is controlled to be uniform on an entire plate in the rolling process. With the temperature control on the start region, the end region and the edge regions of the plate, plate homogeneity of temperature, microstructure and property can be achieved.

The invention presents an on-line cooling system for controlled rolling with an inter-pass cooling process. The cooling system 3 and the water supply system 1 are arranged on the main frame 2, so that the rolling mill and the cooling equipment are combined, and the steel plate can be cooled immediately after each rolling pass. Consequently, satisfied rolling effect in the condition of temperature gradient along thickness direction, grain refinement at the surface and drastic strength improvement without sacrificing toughness are achieved. When steel plate is rolling in the condition of a temperature gradient in the thickness direction, deformation more easily penetrates into the center of the steel plate. For this reason, inner flaws of heavy plates are eliminated, better quality of the center region is obtained, double bulging deformation is avoided and the yield of heavy plate is increased.

At last, all the embodiments above only describe but do not limit the technical solution of the present invention. Although a detailed description is provided with reference to the above mentioned embodiments, a skilled person in the art should understand that the technical solution in these embodiments can still be modified and all or some of the technical features can be equivalently replaced. However, these modifications and replacements do not deviate from the nature of this invention, and their corresponding technical solutions still fall into the scope of the embodiments of this invention.

The invention claimed is:

1. An on-line cooling system for controlled rolling with an inter-pass cooling process, comprising a heavy or thick plate rolling mill and on-line cooling equipment;

wherein a cooling mode of the on-line cooling equipment comprises inter-pass water cooling during a reciprocating rolling process;

wherein the on-line cooling equipment is configured to operate using parameters of rolling heavy steel plates, including a plate temperature in both length and width direction detected by pyrometers each time before cooling;

wherein the on-line cooling equipment is configured such that, during a cooling process of one of the heavy steel plates, a start region, an end region, and edge regions of the heavy steel plate are covered by an edge region cover, start and end region swift cover and water crown according to the plate temperature in both length and width directions detected by the pyrometers, different areas of the heavy steel plate, determined by the plate temperature in both length and width directions detected by the pyrometers, are differentially cooled, and a temperature difference in length and width direction is reduced to achieve good temperature homogeneity on an entirety of the heavy steel plate;

wherein an on-line plate temperature is controlled by adjustment of an amount and a cooling strength of water according to a temperature detected by the pyrometers;

wherein the on-line cooling equipment is accessorily arranged on the exit of the heavy or thick plate rolling mill, so that the heavy or thick plate rolling mill and the on-line cooling equipment are combined;

wherein one heavy or thick plate rolling mill and one on-line cooling equipment are considered as a cooling group, and several such cooling groups are provided so that the heavy steel plate can be cooled in any rolling pass.

2. An on-line cooling system for controlled rolling with an inter-pass cooling process according to claim 1, characterized in that, the on-line cooling equipment comprises a main frame, a cooling system, a water supply system and transfer rollers; the cooling system, the water supply system and the transfer rollers are all arranged on the main frame; the water supply system is connected with the cooling system in order to provide water for the cooling system; the transfer rollers are arranged in parallel; the transfer rollers arranged on the main frame are used to move the steel plate; the cooling system is arranged above and/or under the transfer rollers to cool the plates on the said transfer rollers.

3. An on-line cooling system for controlled rolling with an inter-pass cooling process according to claim 2, characterized in that, the water supply system comprises a storage tank and water piping; the storage tank is arranged on the main frame, and the two ends of the water piping are connected to the storage tank and the cooling system, respectively.

4. An on-line cooling system for controlled rolling with an inter-pass cooling process according to claim 2, characterized in that, the cooling system comprises a header, control valves and a detecting instrument; One end of the header is arranged towards the transfer rollers and the other end is connected with the water supply system; the control valves and the detecting instrument are arranged on the header.

5. An on-line cooling system for controlled rolling with an inter-pass cooling process according to claim 4, characterized in that, the header comprises an inlet pipe, an internal spray tank, an external spray tank, nozzles, and a support; the inlet pipe, the internal spray tank, and the external spray tank are arranged on the support; the two ends of the inlet pipe are connected with the water supply system and the nozzles, respectively.

6. An on-line cooling system for controlled rolling with an inter-pass cooling process according to claim 4, characterized in that, the cooling system also comprises a self-cooling setting for the nozzle, and the said self-cooling setting for the nozzle is on the side of the transfer rollers for cooling the nozzles of the upper and the lower cooling system.

7. An on-line cooling system for controlled rolling with an inter-pass cooling process according to claim 3, characterized in that, the online cooling system also comprises a high pressure side jet water device and air blowing device; both of the said devices are arranged on the main frame and on the side above the transfer rollers.

8. A cooling method for controlled rolling with an inter-pass cooling process, comprising:

detecting a heavy steel plate temperature in length and width direction by pyrometers each time before cooling the heavy steel plate;

during the cooling process of the heavy steel plate, covering a start region, an end region and edge regions of the heavy steel plate using an edge region cover, start and end region swift cover and water crown according to the plate temperature in length and width directions detected by the pyrometers, differentially cooling different areas of the heavy steel plate determined according to the plate temperature in length and width directions detected by the pyrometers and reducing a temperature difference in length and width directions and achieving good temperature homogeneity on an entirety of the heavy steel plate;

controlling an on-line plate temperature by adjustment of an amount and a cooling strength of water according to a temperature detected by the pyrometers; wherein the on-line cooling equipment is accessorily arranged on an entrance and exit of the heavy or thick plate rolling mill, so that prior to rolling of the heavy steel plate by the heavy or thick plate rolling mill, the on-line cooling equipment performs reciprocating cooling to increase a temperature gradient in a thickness direction of the steel plate and decrease surface temperature, resulting in an improvement of deformation penetration of rolling and refinement of microstructure through the thickness direction including at both the surface and the core;

the on-line cooling equipment is accessorily arranged on an exit of the heavy or thick plate rolling mill, so that after rolling of the heavy steel plate by the heavy or thick plate rolling mill, the on-line cooling equipment performs cooling to suppress recovery of steel plate microstructure in a surface layer, recrystallization and grain growing; and the on-line cooling equipment is accessorily arranged on an exit of the heavy or thick plate rolling mill, so that after rolling of the heavy steel plate by the heavy or thick plate rolling mill, the on-line cooling equipment performs reciprocating cooling to make a deforming microstructure in the surface layer subject to transformation-reverse transformation to refine the microstructure in the surface layer.

9. A cooling method for controlled rolling with an inter-pass cooling process according to claim 8, characterized in that, the rolling mill includes a roughing mill and/or a finishing mill, and one or both of them can be used;

the rolling mill is arranged with one single stand mill or a cooperation of one roughing mill and one finishing mill;

when the finishing temperature of rough rolling is low, the rough rolling and the finish rolling can be integrated together; alternatively, when the finishing temperature of rough rolling is high, the cooling process of intermediate slab can reciprocate between the rough rolling and the finish rolling;

when the plate cannot be cooled to the expected temperature in a single pass cooling, reciprocating cooling process can be used during pass until the plate temperature meets the requirement.

* * * * *